US012235024B2

(12) United States Patent
Yang et al.

(10) Patent No.: US 12,235,024 B2
(45) Date of Patent: Feb. 25, 2025

(54) DEFLECTOR FOR CONDENSER, CONDENSER HAVING IT AND CHILLER SYSTEM

(71) Applicant: Carrier Corporation, Palm Beach Gardens, FL (US)

(72) Inventors: Dongsheng Yang, Shanghai (CN); Kai Deng, Shanghai (CN); Yuling Shi, Shanghai (CN); Hongyi Li, Shanghai (CN); Keli Dong, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 277 days.

(21) Appl. No.: 17/746,411

(22) Filed: May 17, 2022

(65) Prior Publication Data

US 2022/0373231 A1 Nov. 24, 2022

(30) Foreign Application Priority Data

May 21, 2021 (CN) ..... 202110558042.7

(51) Int. Cl.
*F25B 39/04* (2006.01)
*F25B 1/06* (2006.01)
*F28F 9/02* (2006.01)

(52) U.S. Cl.
CPC ..... *F25B 39/04* (2013.01); *F25B 1/06* (2013.01); *F28F 9/0265* (2013.01); *F28F 9/028* (2013.01); *F25B 2339/04* (2013.01); *F25B 2500/12* (2013.01); *F25B 2500/13* (2013.01);

(Continued)

(58) Field of Classification Search
CPC ..... F28F 9/0265; F28F 9/028; F25B 39/04
See application file for complete search history.

(56) References Cited

U.S. PATENT DOCUMENTS 1,498,408 A * 6/1924 Stoms ..... F25B 39/04 261/DIG. 7
3,180,405 A * 4/1965 Hinde ..... F28F 1/36 165/184
3,696,883 A 10/1972 Devane (Continued)

FOREIGN PATENT DOCUMENTS

CN 104832247 A 8/2015
CN 108779968 A 11/2018

(Continued)

OTHER PUBLICATIONS

European Search Report for Application No. 22174602.7; Issued Sep. 22, 2022; 8 Pages.

*Primary Examiner* — Christopher R Zerphey
(74) *Attorney, Agent, or Firm* — CANTOR COLBURN LLP

(57) ABSTRACT

A deflector for a condenser, the condenser has an inlet communicated with exhaust pipes of a compressor, and the deflector is provided at the inlet, the deflector includes: a flow guiding structure having a first tube section and a second tube section of increasing diameter, the second tube section being positioned below the first tube section and extending into the condenser when mounted in place; and a support assembly for fixing the flow guiding structure at the inlet, at least a part of the refrigerant gas flow flows through the interior of the first tube section, and at least another part of the refrigerant gas flow flows through the outer side of the first tube section.

10 Claims, 1 Drawing Sheet

(52) U.S. Cl.
CPC ..... *F28F 2265/28* (2013.01); *F28F 2265/30* (2013.01); *F28F 2275/06* (2013.01)

(56) References Cited

U.S. PATENT DOCUMENTS

| | | | | |
|---|---|---|---|---|
| 4,667,770 | A | 5/1987 | Devane | |
| 5,137,439 | A | 8/1992 | Lundin | |
| 5,465,783 | A * | 11/1995 | O'Connor | F28F 19/00 165/174 |
| 5,507,151 | A | 4/1996 | Ring et al. | |
| 6,027,072 | A * | 2/2000 | Black | F28F 3/12 165/41 |
| 7,011,180 | B2 | 3/2006 | Gallagher et al. | |
| 7,578,659 | B2 | 8/2009 | Fox et al. | |
| 8,136,980 | B2 | 3/2012 | Smith | |
| 8,240,367 | B2 * | 8/2012 | Wanni | F28D 9/0075 165/174 |
| 8,276,653 | B2 * | 10/2012 | Al-Anizi | F28D 7/1607 165/161 |
| 8,839,821 | B2 | 9/2014 | Pinkerton | |
| 9,057,391 | B2 | 6/2015 | Sawchuk et al. | |
| 10,386,130 | B2 * | 8/2019 | Eckert | F28F 9/26 |
| 10,539,378 | B2 * | 1/2020 | Diffey | F28F 9/028 |
| 10,612,823 | B2 | 4/2020 | Moreaux | |
| 10,987,644 | B2 * | 4/2021 | Tsunoda | B01J 8/0278 |
| 11,045,779 | B2 * | 6/2021 | Gozzini | F28F 9/026 |

FOREIGN PATENT DOCUMENTS

| | | | |
|---|---|---|---|
| CN | 208332761 | U | 1/2019 |
| CN | 111630329 | A | 9/2020 |
| CN | 212299563 | U | 1/2021 |
| DE | 2706980 | A1 | 8/1978 |
| JP | 3958302 | B2 | 5/2007 |
| JP | 5896876 | B2 | 3/2016 |
| JP | 5971941 | B2 | 7/2016 |
| JP | 2018017408 | A | 2/2018 |
| JP | 2018124024 | A | 8/2018 |
| JP | 6621187 | B2 | 11/2019 |
| JP | 6629627 | B2 | 12/2019 |
| JP | 6787647 | B2 | 11/2020 |
| JP | 6821321 | B2 | 1/2021 |
| JP | 6929806 | B2 | 8/2021 |
| JP | 2021131209 | A | 9/2021 |
| JP | 2023035173 | A | 3/2023 |
| SU | 203708 | A1 | 10/1967 |
| WO | 2008015046 | A1 | 2/2008 |

* cited by examiner

DEFLECTOR FOR CONDENSER, CONDENSER HAVING IT AND CHILLER SYSTEM

FOREIGN PRIORITY

This application claims priority to Chinese Patent Application No. 202110558042.7, filed May 21, 2021, and all the benefits accruing therefrom under 35 U.S.C. § 119, the contents of which in its entirety are herein incorporated by reference.

TECHNICAL FIELD OF INVENTION

The present invention relates to the technical field of heat exchange equipment, in particular to a deflector for a condenser, and also relates to a condenser provided with the deflector for a condenser, and a refrigeration system equipped with the condenser.

BACKGROUND OF THE INVENTION

It is known to those skilled in the art that a condenser belongs to a kind of heat exchange equipment. In a refrigeration system composed of basic components such as compressor, condenser, throttle valve and evaporator, the refrigerant circulates continuously in the system, and exchanges heat with the outside world through its own phase change. The compressor compresses the working medium from low-temperature and low-pressure gas into high-temperature and high-pressure gas, and then condenses it into medium-temperature and high-pressure liquid through the condenser.

At present, a baffle plate is mounted at the position corresponding to the refrigerant inlet port inside the shell of the condenser to reduce the impact force of the high-temperature and high-pressure gas from exhaust pipes of the compressor. When the refrigerant gas flow discharged from the compressor passes through the baffle plate, the huge impact force of the gas flow often causes severe vibration of the entire condenser and produces undesired noise.

Therefore, there is an urgent need to find a deflector for a condenser that can not only reduce the impact force of the refrigerant gas flow, but also reduce vibration and noise.

SUMMARY OF THE INVENTION

In view of the above, according to a first aspect of the present invention, a deflector for a condenser is provided, which effectively solves the aforementioned problems and problems in other aspects existing in the prior art. In the deflector for a condenser according to the present invention, the condenser has an inlet communicated with the exhaust pipes of the compressor, and the deflector is provided at the inlet, wherein the deflector comprises: a flow guiding structure having a first tube section and a second tube section of increasing diameter, the second tube section being positioned below the first tube section and extending into the condenser when mounted in place; and a support assembly for fixing the flow guiding structure at the inlet, wherein at least a part of the refrigerant gas flow flows through the interior of the first tube section, and at least another part of the refrigerant gas flow flows through the outer side of the first tube section.

In another embodiment of the deflector for a condenser according to the present invention, the diameter d of the first tube section is obtained by the following formula: $d=\alpha*D$ where D is the inner diameter of the exhaust pipe, and $0.3\leq\alpha\leq0.9$.

In yet another embodiment of the deflector for a condenser according to the present invention, the second tube section is enlarged at an angle θ between 15-90° with respect to the tube axis.

In another embodiment of the deflector for a condenser according to the present invention, the support assembly comprises a plurality of fins, wherein the number of the fins is six, and the fins are arranged symmetrically or at equal intervals on the outer side of the first tube section.

In yet another embodiment of the deflector for a condenser according to the present invention, the second tube section comprises two notches that are symmetrically arranged thereon.

In another embodiment of the deflector for a condenser according to the present invention, the bottom of the second tube section is provided with a serrated portion.

In yet another embodiment of the deflector for a condenser according to the present invention, the flow guiding structure and the support assembly are integrally formed.

In still another embodiment of the deflector for a condenser according to the present invention, the flow guiding structure is made of steel.

In another embodiment of the deflector for a condenser according to the present invention, the fins are fixed at the inlet by welding.

In addition, according to a second aspect of the present invention, a condenser provided with the aforementioned deflector for a condenser is further provided.

Furthermore, according to a third aspect of the present invention, a refrigeration system comprising the aforementioned condenser is further provided.

It can be appreciated that the deflector for a condenser according to the present invention can not only effectively alleviate the impact of the high-temperature and high-pressure gas flow from the compressor, but also help to reduce the vibration of the condenser during operation and thus reduce noise.

BRIEF DESCRIPTION OF THE DRAWINGS

The technical solutions of the present invention will be described in further detail below in conjunction with the accompanying drawings and embodiments, wherein.

DETAILED DESCRIPTION OF THE INVENTION

Some embodiments of the present invention will be described in detail below with reference to the accompanying drawings. It should be noted that orientation terms such as upper, lower, left, right, front, rear, inner side, outer side, top and bottom mentioned or possibly mentioned in this specification are defined relative to the configurations illustrated in the respective drawings. They are relative concepts, so they may change accordingly according to their different locations and different states of use. Therefore, these and other orientation terms shall not be construed as restrictive terms.

Figure 1:
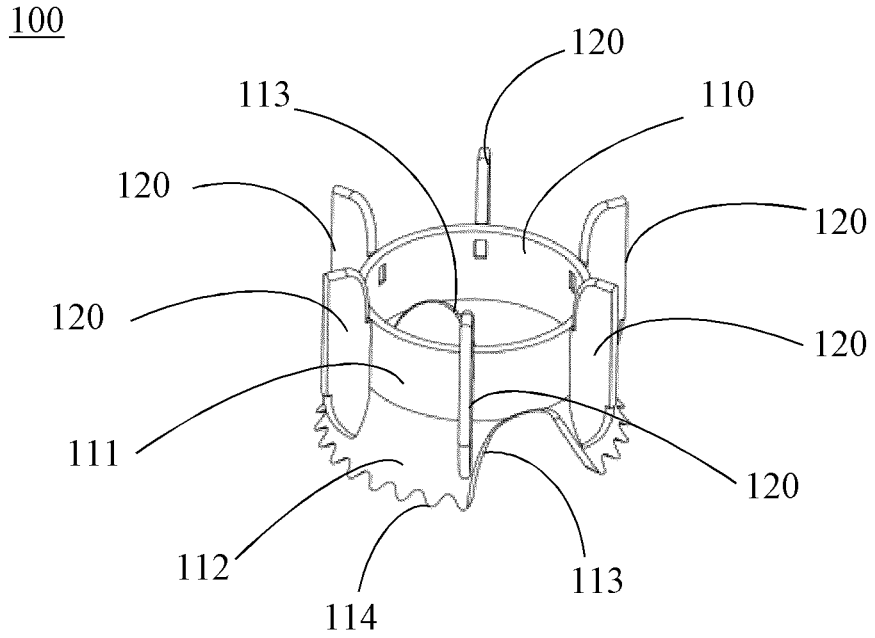
FIG. 1 shows a perspective structural schematic diagram of a deflector for a condenser according to the present invention.

As shown in FIG. 1, it schematically illustrates the structure of an embodiment of a deflector for a condenser according to the present invention in general. It can be seen from FIG. 1 in conjunction with FIG. 2 that the condenser 200 has an inlet communicated with exhaust pipes 300 of the compressor (not shown), and a deflector 100 is provided at the inlet to guide the refrigerant gas flow from the compressor. The deflector 100 may be composed of a flow guiding structure 110 and a support assembly 120. It can be clearly seen from FIG. 1 that the flow guiding structure 110 has a first tube section 111 and a second tube section 112, wherein the first tube section 111 is straight and the second tube section 112 is expanded, that is, the diameter of the second tube section 112 is gradually enlarged. The bottom of the first tube section 111 is almost flush with the inlet portion of the condenser 200, while the second tube section 112 is positioned below the first tube section 111 and extending into the condenser 200 when mounted in place. The support assembly 120 is used to fix the flow guiding structure 110 at the inlet.

Figure 2:
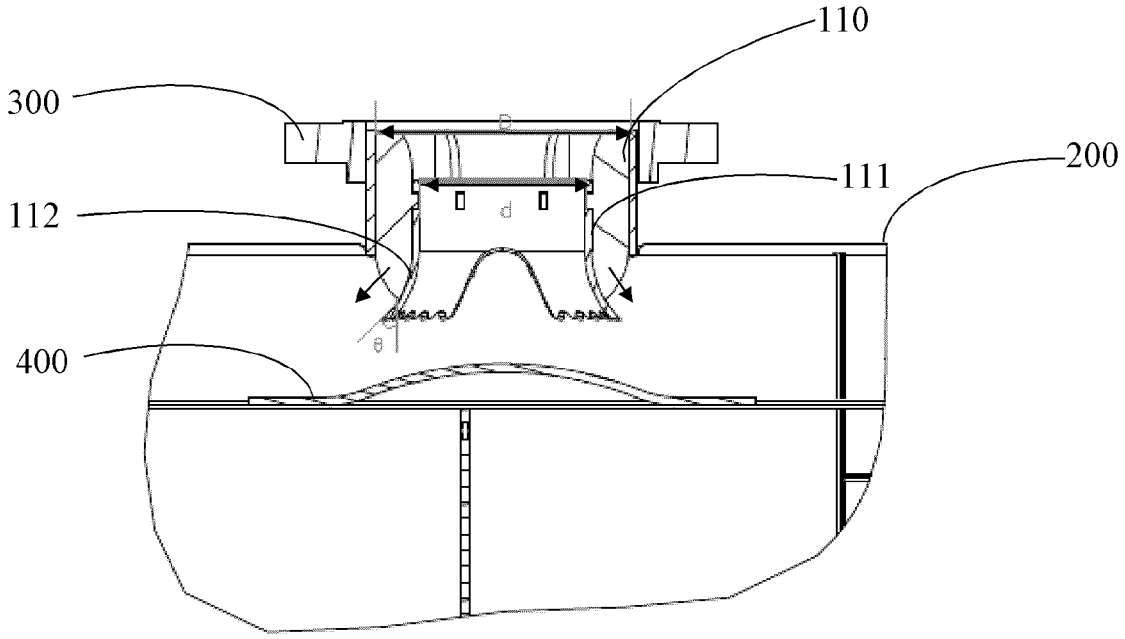
FIG. 2 shows a schematic cross-sectional diagram of the deflector for a condenser in FIG. 1 when it is mounted in the condenser.

It can be seen with reference to FIG. 2 that the high-temperature and high-pressure gas from the exhaust pipes 300 of the compressor is divided into two parts when flowing through the flow guiding structure 110: only a part of the gas flow passes through the interior of the first tube section 111, and then impinges on a baffle plate 400 fixed near the inlet of the condenser 200, so the vibration generated when the gas flow impinges on the baffle plate 400 can be effectively reduced; another part of the gas flow passes through the outer side of the first tube section 111, and this part of the gas flow, through the flared tube below, i.e., the second tube section 112, changes direction and diffuses to the length direction of the condenser 200 (as shown by the arrow in FIG. 2). As such, the flow guiding structure 110 can make the gas flow entering the condenser 200 more evenly distributed.

For the purpose of increasing the flow guiding area, the diameter of the first tube section 111 may be designed depending on the inner diameter of the exhaust pipe 300. Generally, when the diameter of the first tube section 111 is relatively small, the noise reduction effect is relatively good. Specifically, the diameter d of the first tube section 111 can be obtained by the following formula: $d=\alpha*D$, where D is the inner diameter of the exhaust pipe 300, and $0.3\leq\alpha\leq0.9$.

In a preferred embodiment of the present invention, the second tube section 112 is enlarged at an angle θ between 15-90° with respect to the tube axis, so as to better help to evenly disperse the gas flow to the inside of the condenser 200.

In addition, in the embodiment shown in FIG. 1, the support assembly 120 comprises a plurality of fins. As can be seen from FIG. 1, the number of the fins is six, and the fins are arranged symmetrically on the outer side of the first tube section 111, or arranged at equal intervals on the outer side of the first tube section 111. Of course, those skilled in the art can appreciate that the number of the fins is not limited to six, but can be two, three, four, five or others, as long as the fins can ensure the strength of the support assembly and fix the flow guiding structure 110 on the exhaust pipes 300. Furthermore, the fins can be fixed at the inlet by welding or other means.

In order to prevent the gas flow from gathering in the limited space of the second tube section and thus causing pressure amplification, the second tube section 112 can be designed with two notches 113 symmetrically arranged thereon, as shown in FIG. 1. Of course, in the case that, for example, the inner space of the condenser cylinder is relatively large, such a design can be omitted or only part of the notches can be reserved.

Those skilled in the art can appreciate that the bottom of the second tube section 112 may be provided with a serrated portion 114, so that the pressure pulsation inside the condenser 200 can be attenuated to a certain extent, thereby reducing aerodynamic noise. It should be noted that, the serrated portion 114 can be designed in a regular shape, such as a corrugated shape as shown in FIG. 1, or can be designed in an irregular shape, such as a special shape.

As an example, in order to facilitate manufacture, the support assembly 120 and the flow guiding structure 110 may be designed to be integrally formed. In addition, those skilled in the art would readily contemplate that when the manufacturing or processing cost allows, the support assembly can also be mounted on the flow guiding structure as an additional component.

To sum up, the deflector for a condenser according to the present invention can effectively reduce the impact force of the high-temperature and high-pressure gas flow from the compressor, and help reduce the severe vibration caused by the internal structure of the condenser. In addition, the noise generated due to vibration can change its propagation direction by means of the flow guiding structure of the deflector, thereby effectively reducing the noise level of the condenser.

In addition, the present invention provides a condenser provided with the aforementioned deflector for a condenser. Since the deflector is provided inside the condenser, the condenser is less likely to generate undesired noise and vibration during operation. According to the analysis of the engineering simulation software CFD (Computational Fluid Dynamics), the condenser using the deflector can achieve a more uniform temperature distribution along the heat exchange tubes, thereby achieving better heat transfer performance.

Furthermore, the present invention also provides a refrigeration system equipped with the aforementioned condenser. The refrigeration system comprises a cooling tower, a water chiller, a pumping device and the like that are connected by pipelines, wherein, the water chiller is composed of components such as compressor, condenser, throttling device and evaporator. As mentioned above, a condenser provided with the aforementioned deflector can effectively reduce vibration and noise, so it is highly recommended to apply the aforementioned condenser to various refrigeration systems.

Some specific embodiments are listed above to illustrate in detail a deflector for a condenser, a condenser provided with the deflector for a condenser and a refrigeration system equipped with the condenser according to the present invention. These individual examples are only used to illustrate the principle of the present invention and the implementations thereof, but not to limit the present invention. Those skilled in the art may, without departing from the spirit and scope of the present invention, make various modifications and improvements. For example, in order to enable the deflector to withstand the impact of the gas flow, the deflector may be made of steel or other high-strength materials. Therefore, all equivalent technical solutions shall belong to the scope of the present invention and be defined by the various claims of the present invention.

What is claimed is:

1. A deflector for a condenser, the condenser having an inlet communicated with exhaust pipes of a compressor, and the deflector being provided at the inlet, wherein the deflector comprises:

a flow guiding structure having a first tube section and a second tube section of increasing diameter, the second tube section being positioned below the first tube section and configured to extend into the condenser when mounted in place, wherein the second tube section comprises two notches symmetrically arranged thereon, each notch corresponding to absence of the second tube section; and a support assembly for fixing the flow guiding structure at the inlet, wherein the deflector is configured such that, when the deflector is mounted in the condenser, at least a part of refrigerant gas flow flows through interior of the first tube section, and at least another part of the refrigerant gas flow flows through outer side of the first tube section.

2. The deflector according to claim 1, wherein a diameter d of the first tube section is obtained by the following formula:

$$d=\alpha*D$$

where D is an inner diameter of the exhaust pipe, and $0.3\leq\alpha\geq0.9$.

3. The deflector according to claim 2, wherein the second tube section is enlarged at an angle θ between 15-90° with respect to tube axis.

4. The deflector according to claim 1, wherein the support assembly comprises a plurality of fins, wherein the number of the fins is six, and the fins are arranged symmetrically or at equal intervals on the outer side of the first tube section.

5. The deflector according to claim 1, wherein bottom of the second tube section is provided with a serrated portion.

6. The deflector according to claim 1, wherein the flow guiding structure and the support assembly are integrally formed.

7. The deflector according to claim 1, wherein the deflector is made of steel.

8. The deflector according to claim 4, wherein the fins are fixed at the inlet by welding.

9. A condenser, wherein the condenser is provided with the deflector for a condenser according to claim 1.

10. A refrigeration system, wherein the refrigeration system comprises the condenser according to claim 9.

* * * * *